US006984153B2

(12) United States Patent
Lai et al.

(10) Patent No.: US 6,984,153 B2
(45) **Date of Patent: *Jan. 10, 2006**

(54) ELECTRICAL ACCESSORY

(75) Inventors: Wai Hing Lai, Kowloon (HK); Wing Chung Joseph Lau, Pokfulam (HK)

(73) Assignee: Eastern Sources Housewares (Hong Kong) Limited, Kowloon (HK)

( * ) Notice: Subject to any disclaimer, the term of this patent is extended or adjusted under 35 U.S.C. 154(b) by 0 days.

This patent is subject to a terminal disclaimer.

(21) Appl. No.: 10/770,512

(22) Filed: Feb. 4, 2004

(65) Prior Publication Data

US 2005/0170698 A1 Aug. 4, 2005

(51) Int. Cl.
*H01R 33/88* (2006.01)

(52) U.S. Cl. ..... 439/640; 439/135

(58) Field of Classification Search ..... 439/18, 439/21, 135, 640, 651, 923

See application file for complete search history.

(56) References Cited

U.S. PATENT DOCUMENTS

| | | | | |
|---|---|---|---|---|
| 6,116,958 | A * | 9/2000 | Reichle | 439/640 |
| 6,193,522 | B1 * | 2/2001 | Liao | 439/31 |
| 6,213,782 | B1 * | 4/2001 | Derstine | 439/31 |
| 6,364,716 | B1 * | 4/2002 | Seo | 439/640 |
| 6,568,942 | B2 | 5/2003 | Lau et al. | |

* cited by examiner

*Primary Examiner*—Khiem Nguyen
(74) *Attorney, Agent, or Firm*—Buchanan Ingersoll PC

(57) ABSTRACT

An electrical accessory in the form of an electrical adapter (100) is disclosed as including releasably engageable first body part (102) and second body part (104), the first body part (102) being releasably engageable with a plug (14) of an electric cord (10), the second body part (104) being electrically connectable with an electricity mains supply, and the second body part (104) includes a body (115) engageable with the first body part (102) and a plate (122) with electrically conductive pins (124*a,* 124*b,* 124*c*) electrically connectable with the electricity mains supply, and the body (115) and the plate (122) with electrically conductive pins (124*a,* 124*b,* 124*c*) are swivellable relative to each other. The electrical accessory may also be a wall socket (200).

16 Claims, 10 Drawing Sheets

200
204
202

24
202
204

204
202
200

202
204
206c
200
206b
206a

ELECTRICAL ACCESSORY

This invention relates to an electrical accessory, e.g. an electrical adapter, or a wall socket, which enables an electrical appliance with an electric cord to be connected with the mains supply, while allowing the electric cord to be easily detached from the mains supply in suitable circumstances.

BACKGROUND OF THE INVENTION

There are a large variety of electric appliances having different types of detachable electric cords to suit different needs. Most such electric cords have two plug members connected by an electric cable, in which one of the plug members is connectable to the electric appliance, while the other plug member is connectable to an electric source, e.g. a mains socket.

A main shortcoming with such a conventional arrangement is that once the electric cord is engaged with the electric appliance, it is usually very difficult to detach the plug member from the electric appliance. This can be very dangerous if the electric cable is accidentally pulled when the electric appliance is operating. For instance, if a person trips over by the electric cable of an operating electric deep fryer or kettle, the whole appliance unit can be turned over and the contents, e.g. hot oil or boiling water, may be poured out of the deep fryer or kettle, possibly causing serious injuries to the person or other people around.

Ways have thus been proposed to overcome or at least mitigate such shortcomings. In particular, U.S. Pat. No. 6,568,942 issued to Lau et al. (the contents of which are incorporated herein for reference as if wholly repeated here) discloses an electric appliance with a body member and a detachable electric cord. The body member includes a connecting portion having at least one pin member extended therefrom. The electric cord includes at least a first plug member and a second plug member which are electrically connected with each other. The first plug member is electrically connectable to an electric source, e.g. the mains socket, and the second plug member is releasably engageable with the connecting portion of the body member by a magnetic attracting force between them. The pin member includes a taper end surface, and the second plug member includes at least one aperture sized to receive the pin member of the connecting portion of the body member, and $$\frac{\text{width of the aperture}}{\text{width of the pin member}} \text{ is in the range of 1.1 to 5.}$$

Despite the availability of such an easily detachable electric cord, there are still in existence a large variety of electric appliances already manufactured and equipped with conventional electric cords fixedly attached thereto.

It is thus an object of the present invention to provide an electrical accessory enabling an electric cord to be connected with the mains supply, while allowing the electric cord to be easily detached from the mains supply in appropriate circumstances.

SUMMARY OF THE INVENTION

According to a first aspect of the present invention, there is provided an electric accessory including releasably engageable first and second body members, said first body member including a receiving portion adapted to be releasably engageable with a plug member of an electric cord, said second body member being electrically connectable with an electricity mains supply, wherein said second body member includes a first part engageable with said first body member and a second part adapted to be electrically connectable with said electricity mains supply, wherein said first part and said second part are swivellable relative to each other.

The first body member may advantageously include a plurality of electrically conductive pins releasably receivable within corresponding plurality of apertures of said second body member. By way of such an arrangement, electrical connection between the first and second body members is established when they are engaged with each other.

Suitably, said second body member may include a shutter member movable between a first position in which access to said apertures is denied and a second position in which access to said apertures is allowed, and said shutter member may be biased towards said first position. Such ensures that when the first and second body members are disengaged from each other, even if the second body member is electrically connected with the mains supply, access to the apertures of the second body member is denied, thus assisting in preventing accidents from happening.

Advantageously, said second body member may include at least one stopper for limiting the extent of relative swivelling movement between said first part and said second part. Such can prevent uncontrolled and undesirable swivelling or rotational movement between the first and second parts of the second body. Said first and second parts of said second body member may suitably be swivellable relative to each other by up to 180°, and preferably up to 340°. Said first part may advantageously be swivellable relative to said second part about an axis which is substantially perpendicular to a longitudinal axis of said second part.

Conveniently, said second part may include a plurality of electrically conductive pin members adapted to be received within apertures of a wall socket, and said pin members may be fixedly secured to said second part.

Advantageously, said accessory may comprise an electric adapter adapted to be releasably engageable with a wall socket. Alternatively, said accessory may comprise a wall socket portion adapted to be fixed secured to a wall, in which case said second part of said second body member may be adapted to be fixedly secured to a wall.

According to a second aspect of the present invention, there is provided an electric accessory including releasably engageable first and second body members, said first body member including a receiving portion adapted to be releasably engageable with a plug member of an electric cord, said second body member being electrically connectable with an electricity mains supply, wherein said second body member includes a first part engageable with said first body member and a second part adapted to be electrically connectable with said electricity mains supply, wherein one of said first and second body members includes a plurality of pin members, wherein the other of said first and second body members includes a plurality of apertures each sized to receive one of said pin members, and wherein for each corresponding pair of aperture and pin member, $$\frac{\text{width of said aperture}}{\text{width of said pin member}} \text{ is from 1.1 to 5.}$$

BRIEF DESCRIPTION OF THE DRAWINGS

Preferred embodiments of the present invention will now be described, by way of example only, with reference to the accompanying drawings, in which.

DETAILED DESCRIPTION OF THE PREFERRED EMBODIMENTS

Figures 1A, 1B:
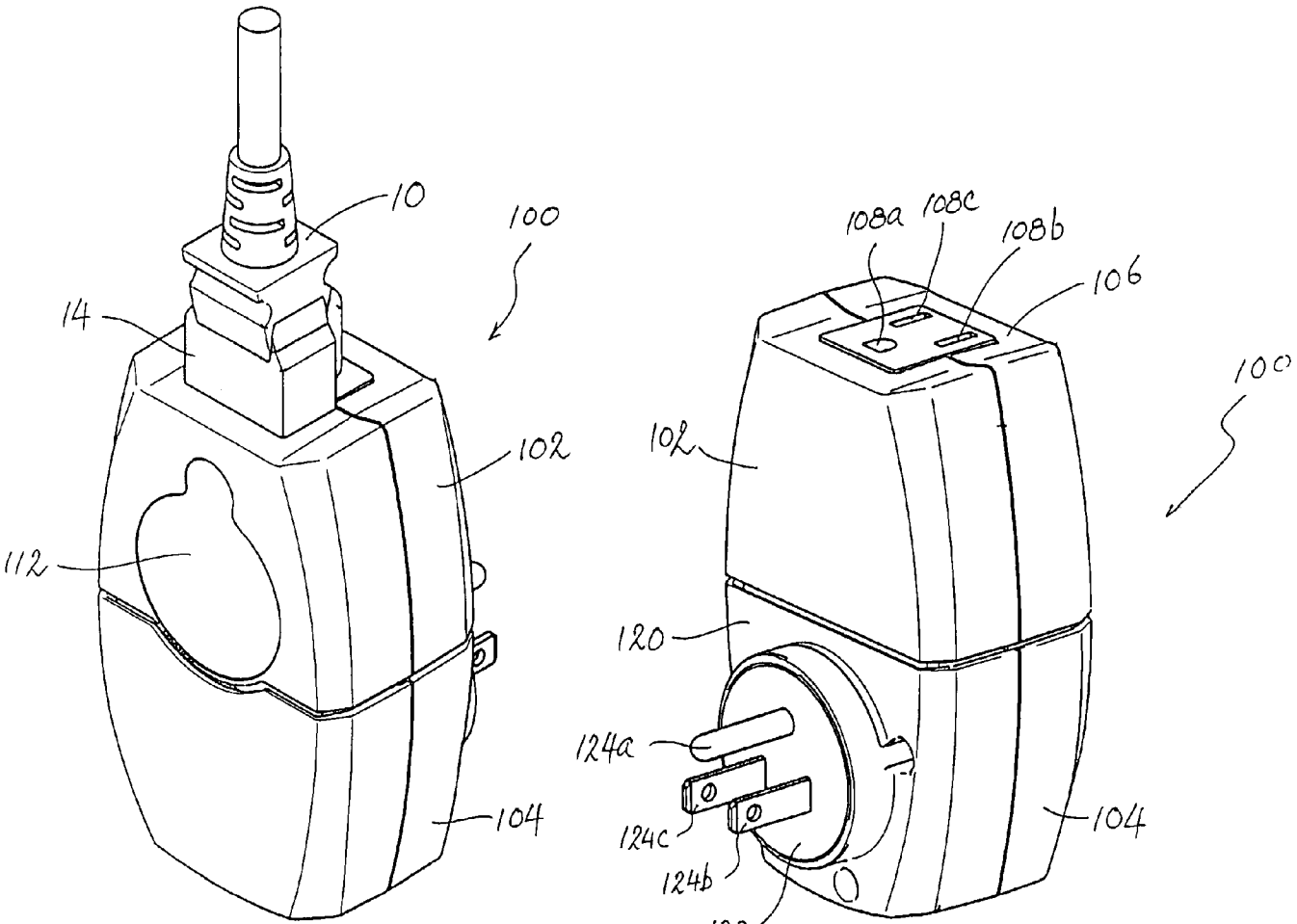
FIG. 1A shows a front perspective view of an electrical adapter according to a first embodiment of the present invention, as attached with an electric cord.
FIG. 1B shows a rear perspective view of the electrical adapter shown in FIG. 1A, with the electric cord removed.
Figure 2:
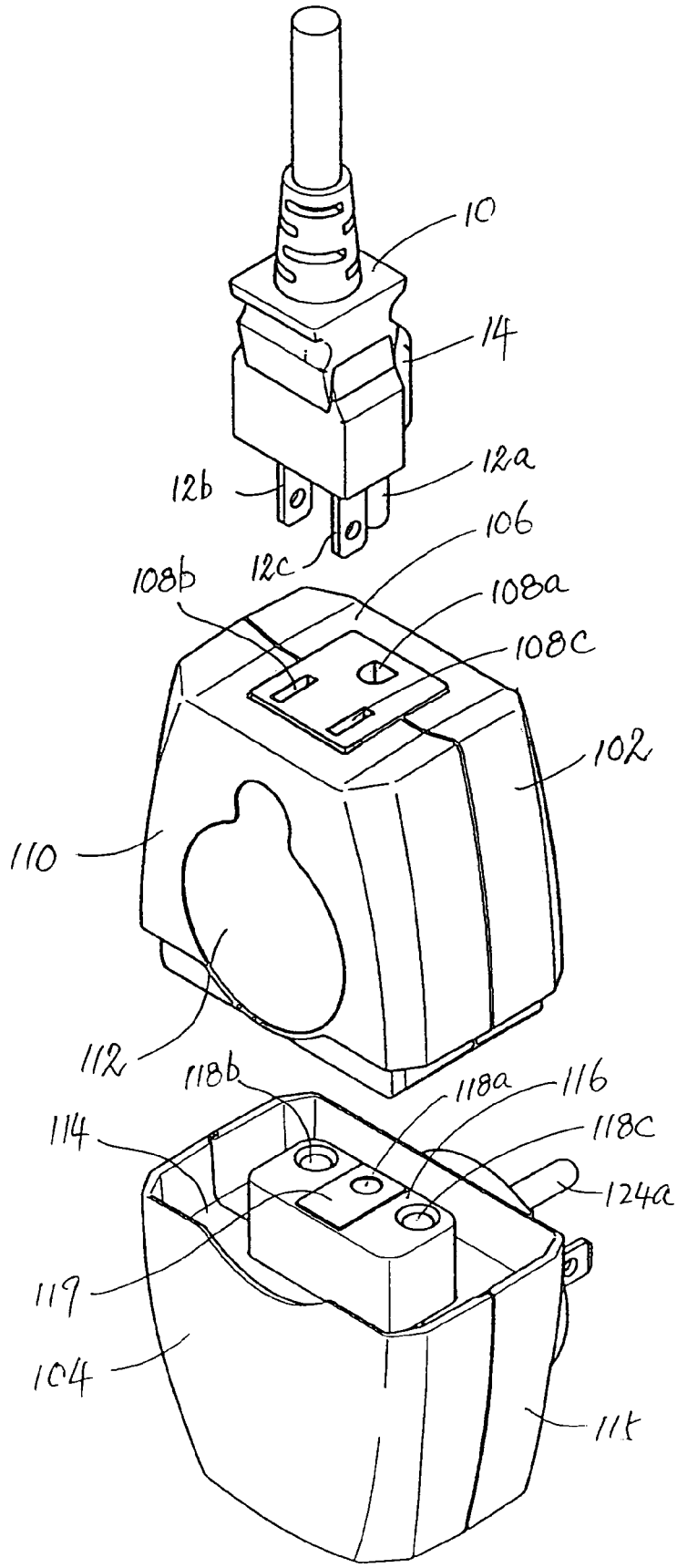
FIG. 2 is shows a further front perspective view of the electrical adapter shown in FIG. 1A, with the electric cord, upper body part and lower body part detached from one another.

An electrical accessory according to a first preferred embodiment of the present invention, being an electrical adapter generally designated as 100, is shown in FIGS. 1A to 2. In FIG. 1A, the electrical adapter 100 is shown as releasably connected with a conventional electric cable 10, not forming part of the present invention. The electrical adapter 100 includes an upper body part 102 and a lower body part 104, which are releasably engageable with each other.

On an upper surface 106 of the upper body part 102 are three apertures 108*a*, 108*b*, 108*c* for receiving respective correspondingly shaped and configured electrically conductive pins 12*a*, 12*b*, 12*c* of a plug 14 of the cable 10. As in conventional sockets, electrically conductive plates, e.g. copper plates, are provided in the apertures 108*a*, 108*b*, 108*c*. The pins 12*a*, 12*b*, 12*c* may thus be inserted into the apertures 108*a*, 108*b*, 108*c* for physically connecting the cable 10 with the adapter 100, and establishing electrical connection between the cable 10 and the adapter 100. On a front surface 110 of the upper body part 102 is a panel 112 on which a trade mark of the manufacturer may be affixed. The panel 112 can also serve the purpose of signifying to the user that this front surface 110 is intended to face the outside when in use. This can assist in minimizing attempts of inappropriate connection between the upper body part 102 and the lower body part 104.

As to the lower body part 104, such has a recess 114 on an upper end of its body 115. From the recess 114 extends a receiving portion 116 with three apertures 118*a*, 118*b*, 118*c*, for receiving correspondingly shaped and configured electrically conductive pins (see FIG. 3B) on an underside of the upper body part 102, so that the pins may be inserted into the apertures 118*a*, 118*b*, 118*c* of the lower body part 104 for physically connecting the upper body part 102 and the lower body part 104, and establishing electrical connection therebetween. The structure of the receiving portion 116 is similar to the plug disclosed in Lau et al. A similar shutter mechanism including a shutter and a spring is also provided in the receiving portion 116, in which the shutter is movable between a closed position in which access to the apertures 118*a*, 118*b*, 118*c* is denied, and an open position in which access to the apertures 118*a*, 118*b*, 118*c* is allowed. The spring acts to bias the shutter to the closed position.

On the receiving portion 116 and around the aperture 118*a* is a magnetic plate 119 which assists in engagement between the lower body part 104 and the upper body part 102, in a manner to be discussed below.

On a rear surface 120 of the lower body part 104 is a circular plate 122 fixedly secured with three electrically conductive pins 124*a*, 124*b*, 124*c*, shaped and configured for plugging into a wall socket (not shown), thus allowing the lower body part 104 to be secured with the wall socket. The pin 12*a* of the cable 10 is electrically connected with the pin 124*a*, via the aperture 108*a* of the upper body part 102, a pin on an underside of the upper body 102, and the aperture 118*a* of the lower body part 104. The pin 12*b* of the cable 10 is electrically connected with the pin 124*b*, via the aperture 108*b* of the upper body part 102, a pin on an underside of the upper body 102, and the aperture 118*b* of the lower body part 104. The pin 12*c* of the cable 10 is electrically connected with the pin 124*c*, via the aperture 108*c* of the upper body part 102, a pin on an underside of the upper body 102, and the aperture 118*c* of the lower body part 104. The circular plate 122, together with the three pins 124*a*, 124*b*, 124*c*, are swivellable relative to the body 115 of the lower body part 104.

Figure 3B:
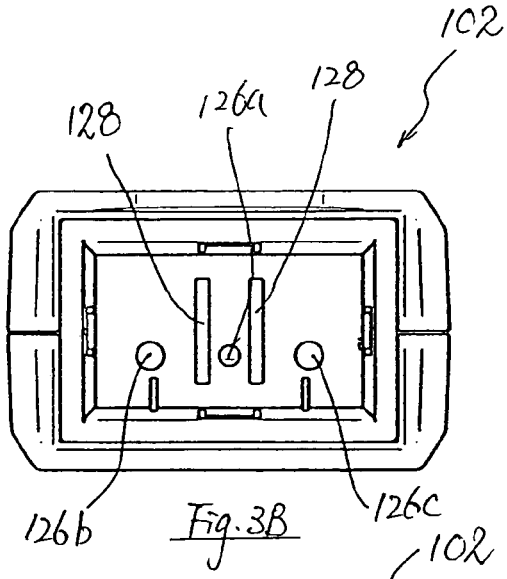
FIG. 3B is a bottom view of the upper body part of the electrical adapter shown in FIG. 3A.
Figure 3A:
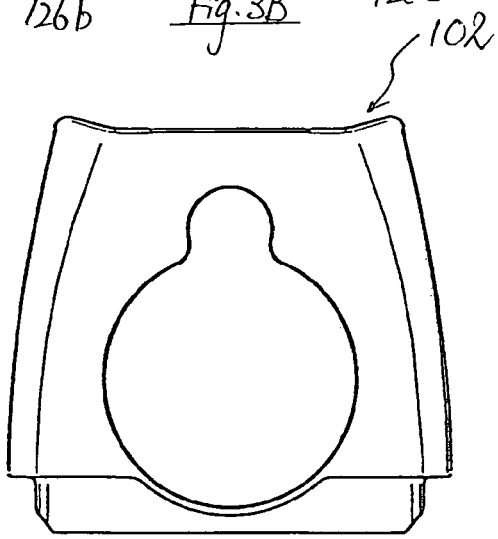
FIG. 3A is a front view of the upper body part of the electrical adapter shown in FIG. 1A.
Figure 3D:
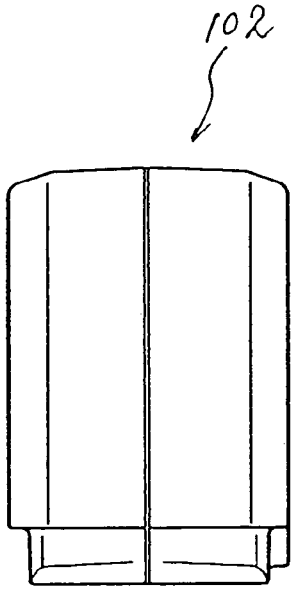
FIG. 3D is a side view of the upper body part of the electrical adapter shown in FIG. 3A.
Figure 3C:
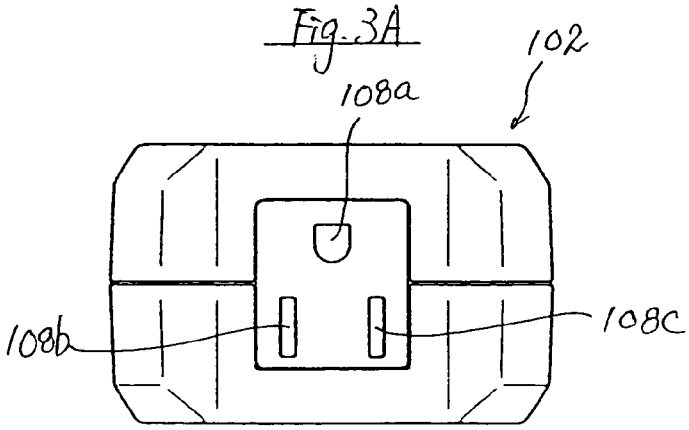
FIG. 3C is a top view of the upper body part of the electrical adapter shown in FIG. 3A.

FIGS. 3A to 3D show, respectively, a front view, a bottom view, a top view, and a side view of the upper body part 102 of the electrical adapter 100. Referring in particular to FIG. 3B, it can be seen that three electrically conductive pins 126*a*, 126*b*, 126*c* extend from an underside of the upper body part 102. The pin 126*a* is receivable within the aperture 118*a*, the pin 126*b* receivable within the aperture 118*b*, and the pin 126*c* receivable within the aperture 118*c*, enabling the upper body part 102 and the lower body part 104 to be physically and electrically connected with each other.

The shapes and configuration of the pins 126*a*, 126*b*, 126*c*, and their inter-relationship, in particular their relative dimension, with the apertures 118*a*, 118*b*, 118*c*, whereby the upper body part 102 and the lower body part 104 can be engaged with each other and be readily disengageable from each other, are clearly and fully described and disclosed in Lau et al. More particularly, for each pair of pin and aperture, namely the pin 126*a* and the corresponding aperture 118*a*, the pin 126*b* and the aperture 118*b*, and the pin 126*c* and the aperture 118*c*, $$\frac{\text{width of said aperture}}{\text{width of said pin member}} \text{ is from 1.1 to 5.}$$

Although in the example as now described, the pins 126*a*, 126*b*, 126*c* are carried by the upper body part 102, and the apertures 118*a*, 118*b*, 118*c* are provided in the lower body part 104, it is envisaged as encompassed within the ambit the scope of this patent the arrangement that the pins are carried by the lower body part 104 and corresponding apertures are provided in the upper body part 102.

Returning to the present example, positioned on either side of the pin 126*a* is a respective magnetic plate 128. When the upper body part 102 and the lower body part 104 are properly engaged with each other, in particular when the pins 126*a*, 126*b*, 126*c* are received within the apertures 118*a*, 118*b*, 118*c* of the receiving portion 116 of the lower body part 104, the magnetic plates 128 are in abutment with and magnetically held to the magnetic plate 119 of the receiving portion 116. The appropriate attractive magnetic force for holding the magnetic plates 128 and the magnetic plate 119 together, while allowing easy disengagement when appropriate, has been fully discussed and disclosed in Lau et al.

Figure 4:
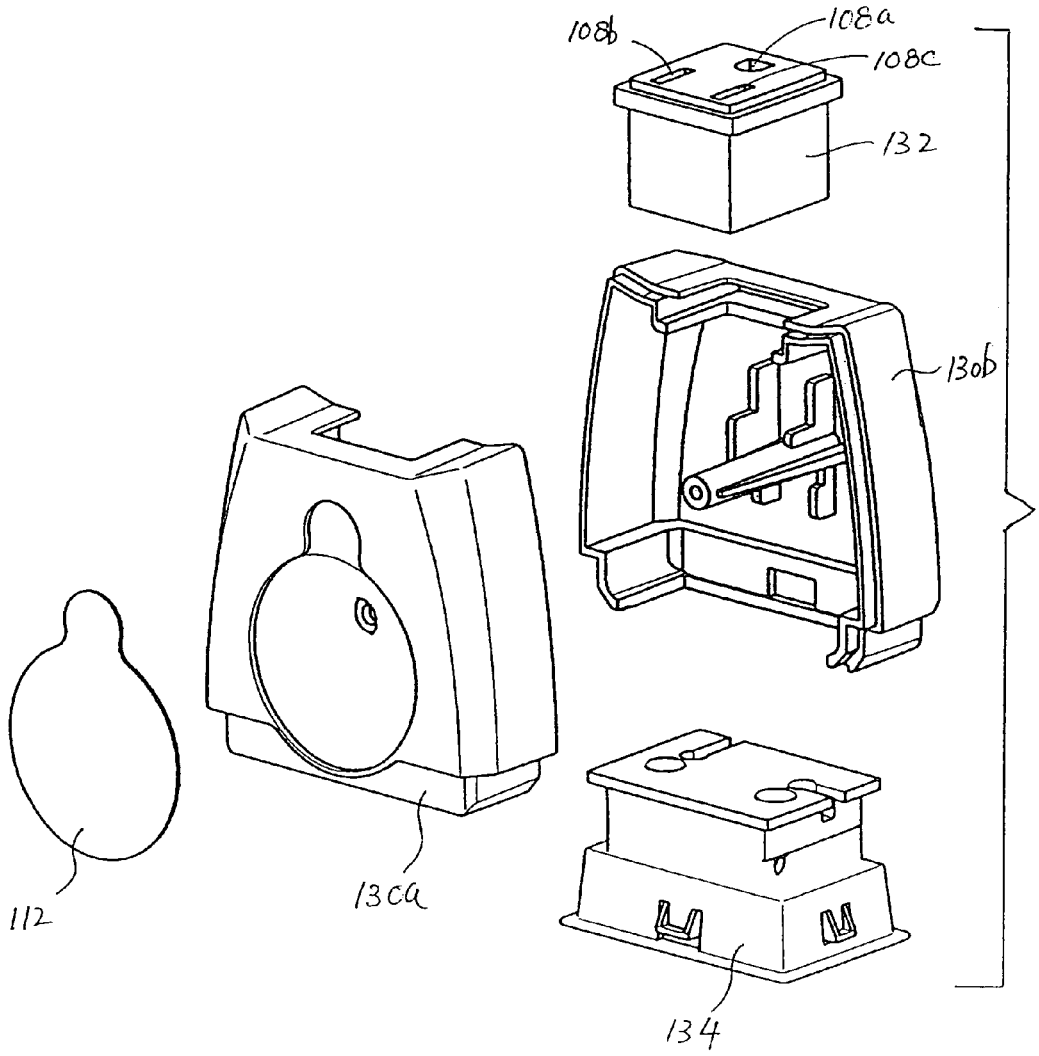
FIG. 4 is a front exploded view of the upper body part of the electrical adapter shown in FIG. 3A.
Figure 5:
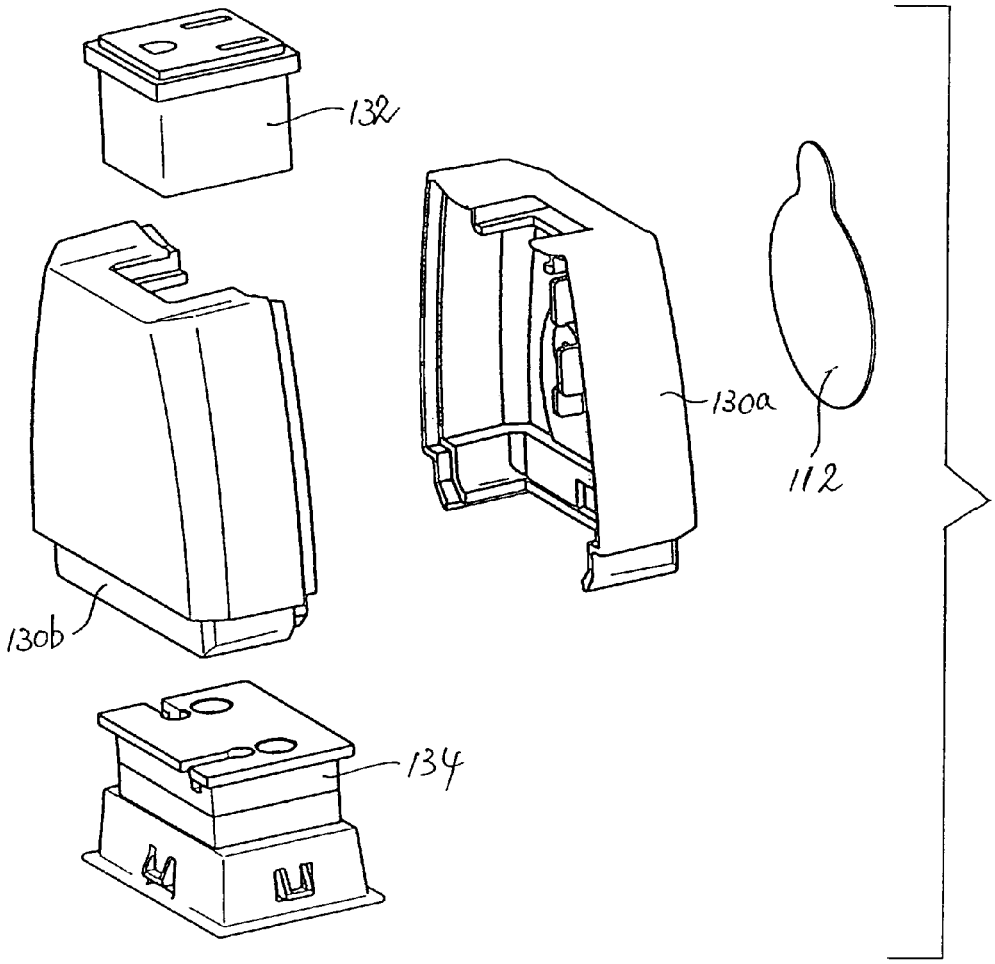
FIG. 5 is a rear exploded view of the upper body part of the electrical adapter shown in FIG. 3A.

As shown in the exploded views in FIGS. 4 and 5, the upper body part 102 has two outer halves 130*a*, 130*b*, which are engaged with each other to hold therebetween a socket module 132 and a plug module 134. The socket module 132 includes the three apertures 108*a*, 108*b*, 108*c* for connection with the plug 14 of the cable 10. The plug module 134 is fixedly secured with the three electrically conductive pins 126*a*, 126*b*, 126*c* for connection with the lower body part 104. Electrically conductive wires (not shown here for clarity purpose) connect the apertures 108*a*, 108*b*, 108*c* with the respective electrically conductive pins 126*a*, 126*b*, 126*c* of the socket plug module 134.

Figure 6B:
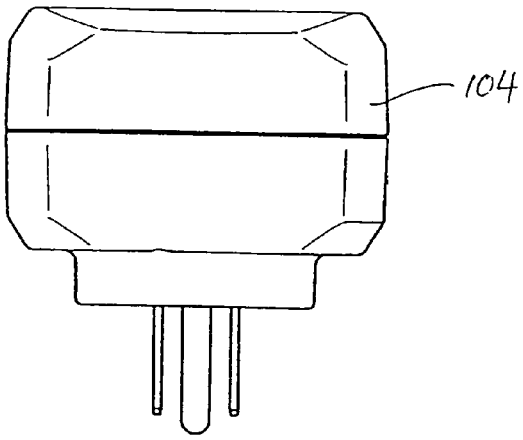
FIG. 6B is a bottom view of the lower body part of the electrical adapter shown in FIG. 6A.
Figure 6A:
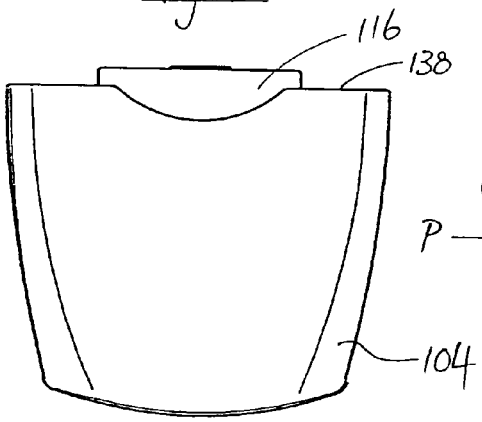
FIG. 6A is a front view of the lower body part of the electrical adapter shown in FIG. 1A.
Figure 6D:
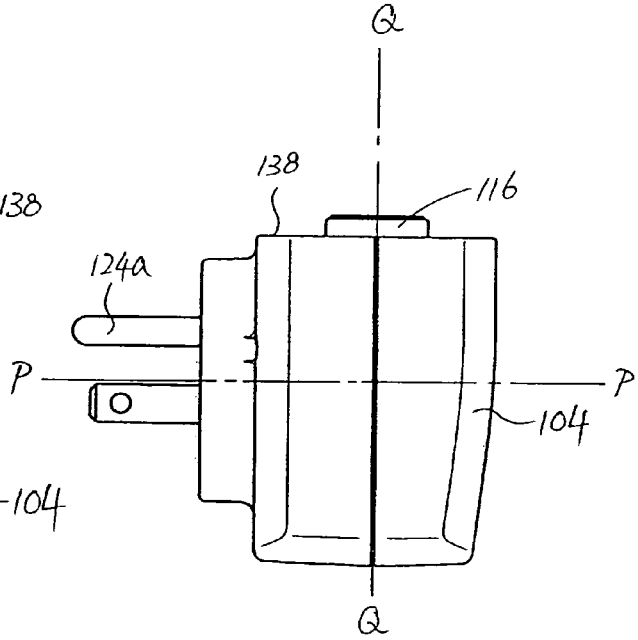
FIG. 6D is a side view of the lower body part of the electrical adapter shown in FIG. 6A.
Figure 6C:
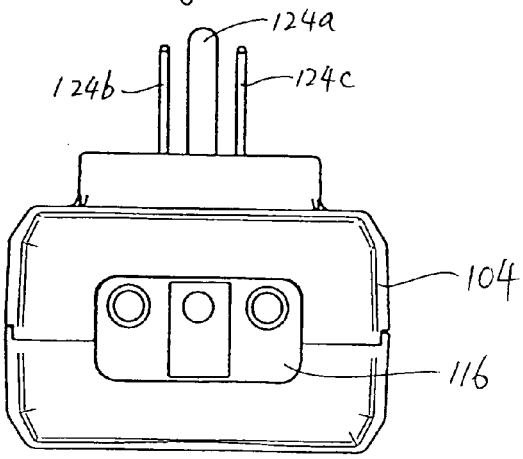
FIG. 6C is a top view of the lower body part of the electrical adapter shown in FIG. 6A.

FIGS. 6A to 6D show, respectively, a front view, a bottom view, a top view, and a side view of the lower body part 104 of the electrical adapter 100. Referring in particular to FIGS. 6A and 6D, it can be seen that the receiving portion 116 extends above the rim 138 of the body 115 of the lower body part 104. Such an arrangement enhances easy disengagement between the upper body part 102 and the lower body part 104. The plate 122 and the three electrically conductive pins 124*a*, 124*b*, 124*c* are swivellable relative to the body 115 of the lower body part 104 about an axis P—P, which is perpendicular to a longitudinal axis Q—Q of the body 115 of the lower body part 104.

Figure 8:
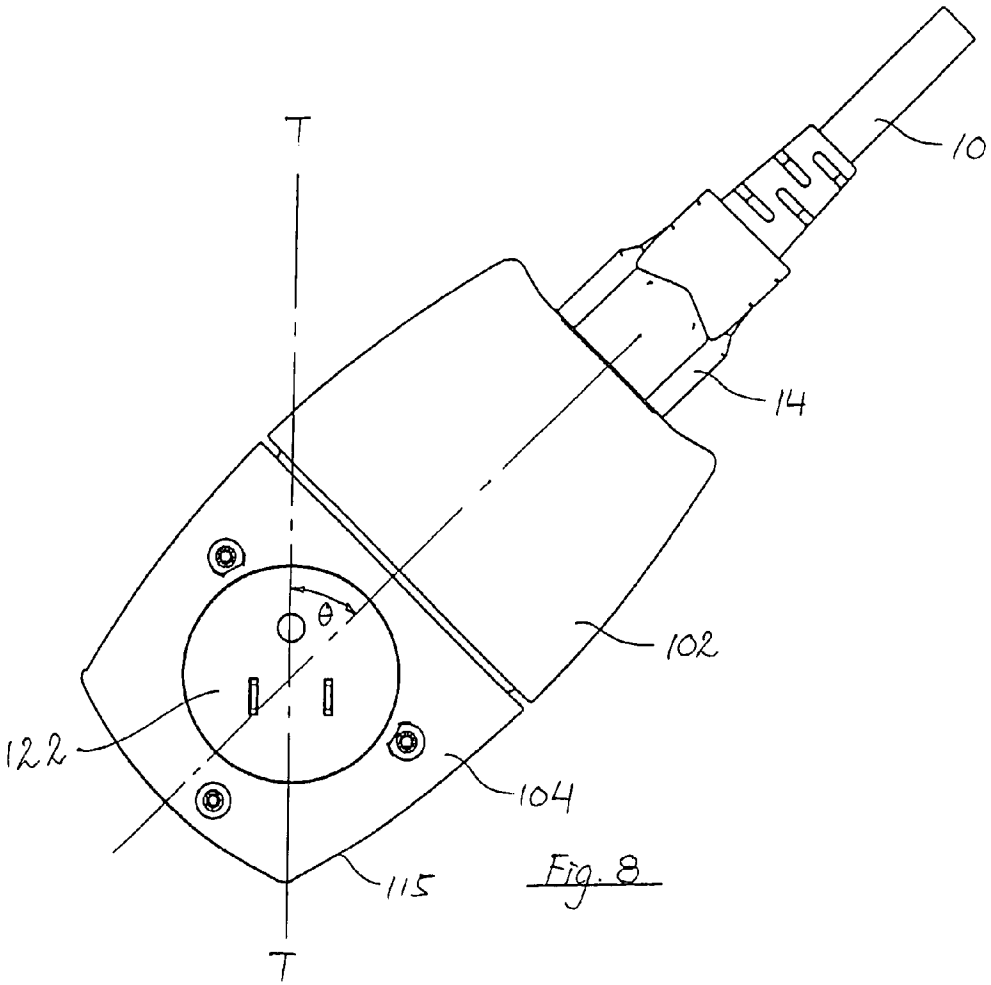
FIG. 8 shows the electrical adapter shown in FIG. 7 in an alternative configuration.
Figure 7:
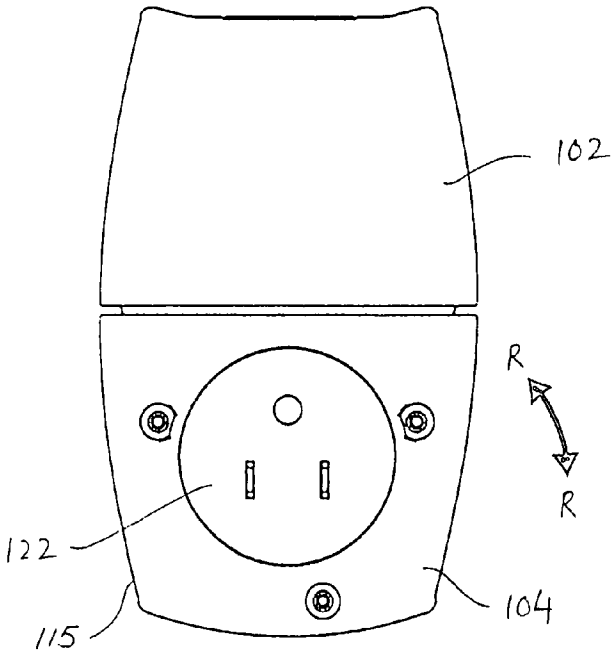
FIG. 7 shows a rear view of the electrical adapter shown in FIG. 1A in a first configuration.

By way of the aforesaid arrangement, when in use, the upper body part 102 and the body 115 of the lower body part 104 may be swivelled relative to the circular plate 122 from the position shown in FIG. 7 in which the adapter 100 is in an upright position, e.g. to assume the position as shown in FIG. 8, in which the adapter 100 is slanted relative to a vertical axis T—T. Thus if the cable 10 is accidentally tripped over and pulled, the adapter 102 (minus the plate 122) may be swivelled in a clockwise or anti-clockwise direction, as indicated by the bi-directional arrow R—R in FIG. 7. If the pulling force is sufficiently strong, the upper body part 102 can be easily disengaged from the lower body part 104, thus minimizing the risk of accidentally pulling and turning over the entire electric appliance with which the cable 10 is connected. The adapter 100 may be swivelled relative to the circular plate 122 clockwise and anti-clockwise by an angle θ each up to 90° relative to the vertical axis T—T, i.e. a total of 180° between its two extreme positions. To allow more flexibility, the adapter 100 may be swivelled relative to the circular plate 122 clockwise and anti-clockwise each by an angle θ up to 170° relative to the vertical axis T—T, i.e. a total of 340° between its two extreme positions.

Figure 9:
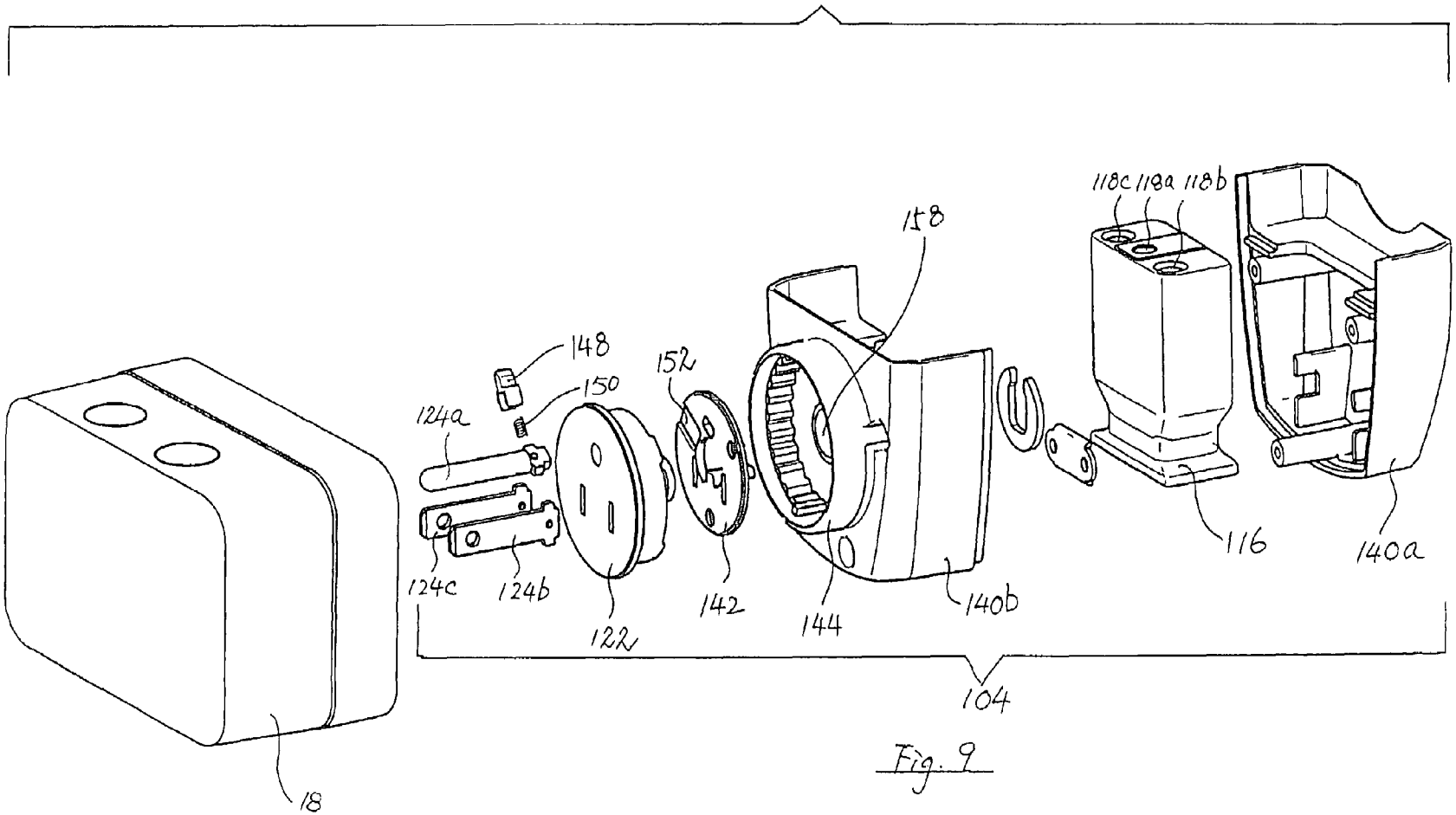
FIG. 9 is a rear exploded perspective view of the lower body part of the electrical adapter shown in FIG. 1A with a wall socket.
Figure 10:
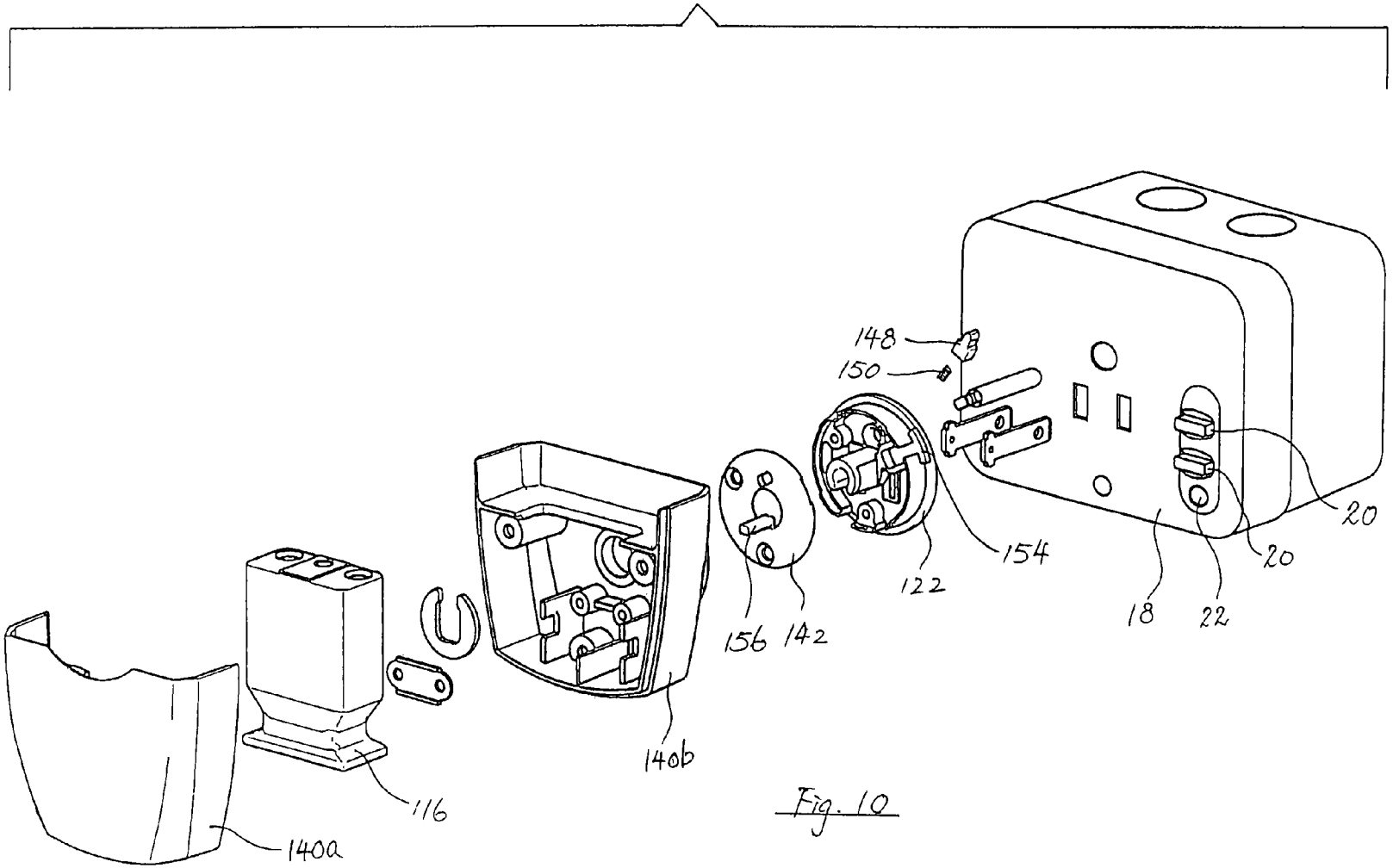
FIG. 10 is a front exploded perspective view of the lower body part of the electrical adapter shown in FIG. 9 with a wall socket.

FIGS. 9 and 10 show, respectively, a rear exploded perspective view and a front exploded perspective view of the lower body part 104 of the electrical adapter 100 with a wall socket 18. The wall socket 18 may be fixedly secured in a wall, so that electricity mains supply may be connected with the socket 18. As shown in FIG. 10, the wall socket 18 includes switches 20 for controlling the operation of the socket 18. A light 22 is also provided on the wall socket 18 for signifying whether the wall socket 18 is in operation.

As shown in FIGS. 9 and 10, the lower body part 104 includes two outer halves 140*a*, 140*b* which are engaged with each other to hold therebetween the receiving portion 116. As mentioned above, on an upper end of the receiving portion 116 are the three apertures 118*a*, 118*b*, 118*c*, for receiving correspondingly shaped and configured electrically conductive pins 126*a*, 126*b*, 126*c* extending from an underside of the upper body part 102. Electrical wires (not shown) are provided to electrically connect electrically conductive parts (not shown) in the aperture 118*a*, 118*b* and 118*c* with the pins 124*a*, 124*b* and 124*c* respectively.

The circular plate 122, with which the pins 124*a*, 124*b* and 124*c* are secured, is engaged via an intermediate plate 142 with a protruding portion 144. As can be seen more clearly in FIG. 9, the inner surface 146 of the protruding portion 144 is corrugated. A finger 148 is engaged via a spring 150 to slide on a recess 152 of the intermediate plate 142. When the circular plate 122 and the intermediate plate 142 are assembled with each other, the finger 148 may slide on the recess 152 and reciprocate through an opening 154 of the circulate 122 (see FIG. 10). When the circulate plate and the accompanying pins 124*a*, 124*b* and 124*c* and intermediate plate 142 swivel relative to the body 115 of the lower body part 104, the exterior end of the finger 148 will travel along the corrugated inner surface 146 of the protruding portion 144. A finger 156 carried by the intermediate plate 142 is received within a hole 158 of the outer half 140*b* of the lower body part 104. The finger 156 co-operates with a stopper (not shown) carried by the outer half 140*b* of the lower body part 104 to limit the extent of swivelling movement between the circular plate 122 and the lower body part 104, as discussed above.

Figures 11A, 11B, 11C, 11D:
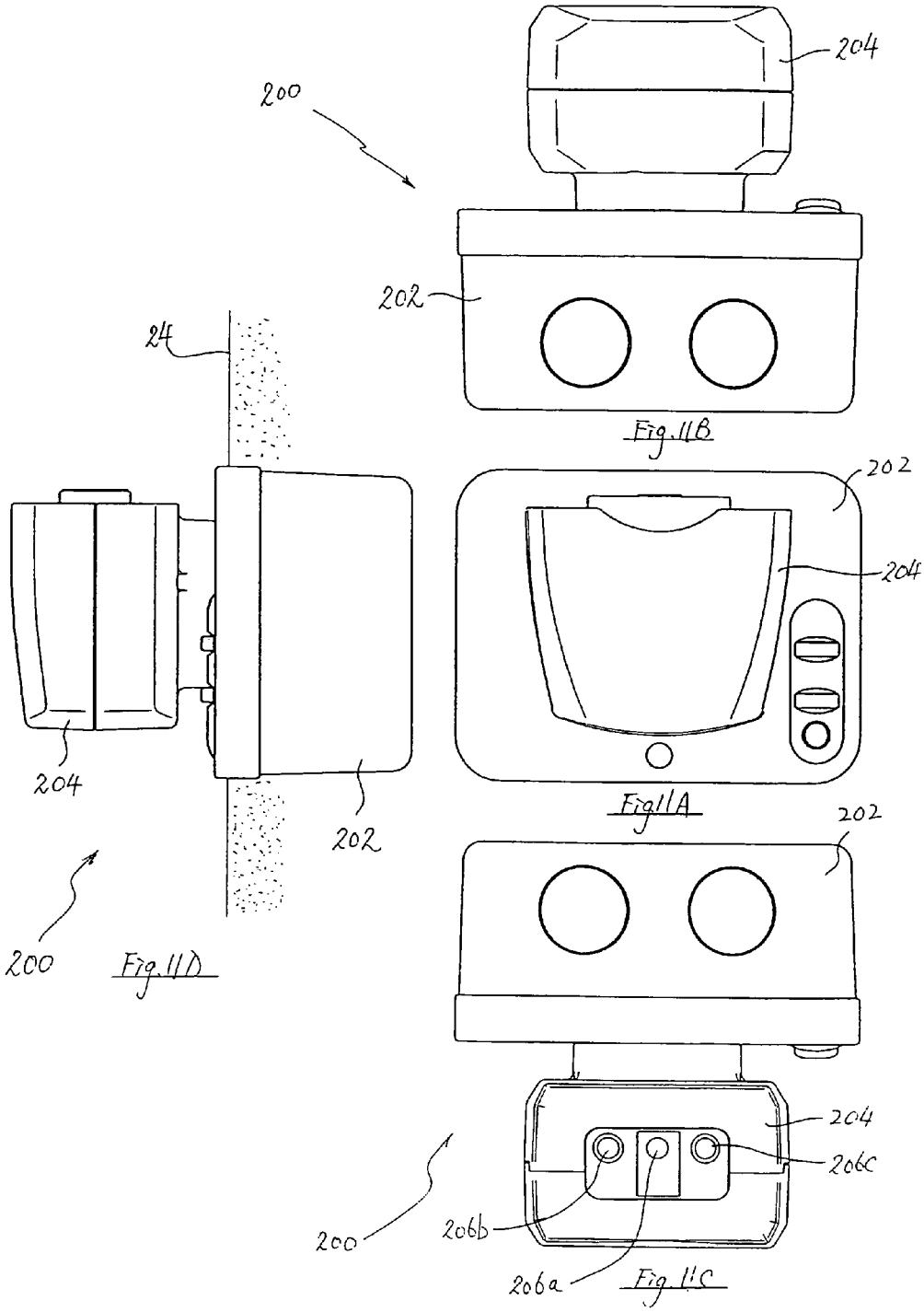
FIG. 11A shows a front view of a wall socket according to a second embodiment of the present invention.
FIG. 11B is a bottom view of the wall socket shown in FIG. 11A.
FIG. 11C is a top view of the wall socket shown in FIG. 11A.
FIG. 11D is a side view of the wall socket shown in FIG. 11A, shown as installed on a wall.

An electrical accessory according to a second preferred embodiment of the present invention, being a wall socket generally designated as 200, is shown in FIGS. 11A to 11D. As can be seen, the wall socket 200 includes a base portion 202 which may be fixedly installed in a wall 24, as shown in FIG. 11D, and a lower body part 204. Mains electricity supply may be connected to the base portion 202, as in the case of conventional wall sockets. Although, for brevity reason, the wall socket 200 is shown here as only including the base portion 200 and the lower body part 204, it should be understood that an upper body part complementary with the lower body part 204, e.g. the upper body part 102 discussed in the preceding preferred embodiment, is also included. Electrically conductive plates, e.g. copper plates, in apertures 206*a*, 206*b*, 206*c* of the lower body part 204 are connected with the electric wires of the mains supply.

In the wall socket 200, the lower body part 204 is swivellable relative to the base portion 202. Thus, when the wall socket 200 is secured to a wall, a complementary upper body part is engaged with the lower body part 204, and an electric plug with an electric cable is plugged into the upper body part, if the electric cable is tripped over, the lower body part 204 will swivel relative to the base portion 202. If the pulling force is sufficiently large, the upper body part will be detached from the lower body part 204, thus minimizing the risk of overturning the electrical equipment with which the electric cable is engaged.

It should be understood that the above only illustrates examples whereby the present invention may be carried out, and that various modifications and/or alterations may be made thereto without departing from the spirit of the invention.

It should also be understood that certain features of the invention, which are, for clarity, described in the context of separate embodiments, may be provided in combination in a single embodiment. Conversely, various features of the invention which are, for brevity, described in the context of a single embodiment, may also be provided separately or in any appropriate sub-combinations.

What is claimed is:

1. An electric accessory including releasably engageable first and second body members, said first body member including a receiving portion adapted to be releasably engageable with a plug member of an electric cord, said second body member being electrically connectable with an electricity mains supply, wherein said second body member includes a first part engageable with said first body member and a second part adapted to be electrically connectable with said electricity mains supply, wherein said first part and said second part are swivellable relative to each other.

2. An accessory according to claim 1 wherein said first body member includes a plurality of electrically conductive pins releasably receivable within corresponding plurality of apertures of said second body member.

3. An accessory according to claim 2 wherein said second body member includes a shutter member movable between a first position in which access to said apertures is denied and a second position in which access to said apertures is allowed.

4. An accessory according to claim 3 wherein said shutter member is biased towards said first position.

5. An accessory according to claim 1 wherein said second body member includes at least one stopper for limiting the extent of relative swivelling movement between said first part and said second part.

6. An accessory according to claim 1 wherein said first and second parts of said second body member are swivellable relative to each other by up to 180°.

7. An accessory according to claim 1 wherein said first and second parts of said second body member are swivellable relative to each other by up to 340°.

8. An accessory according to claim 1 wherein said first part is swivellable relative to said second part about an axis which is substantially perpendicular to a longitudinal axis of said second part.

9. An accessory according to claim 1 wherein said second part includes a plurality of electrically conductive pin members adapted to be received within apertures of a wall socket.

10. An accessory according to claim 9 wherein said pin members are fixedly secured to said second part.

11. An accessory according to claim 1 wherein said accessory comprises an electric adapter adapted to be releasably engageable with a wall socket.

12. An accessory according to claim 1 wherein said accessory comprises a wall socket portion adapted to be fixed secured to a wall.

13. An accessory according to claim 12 wherein said second part of said second body member is adapted to be fixedly secured to a wall.

14. An electric accessory including releasably engageable first and second body members, said first body member including a receiving portion adapted to be releasably engageable with a plug member of an electric cord, said second body member being electrically connectable with an electricity mains supply, wherein said second body member includes a first part engageable with said first body member and a second part adapted to be electrically connectable with said electricity mains supply, wherein one of said first and second body members includes a plurality of pin members, wherein the other of said first and second body members includes a plurality of apertures each sized to receive one of said pin members, and wherein for each corresponding pair of aperture and pin member, $$\frac{\text{width of said aperture}}{\text{width of said pin member}} \text{ is from 1.1 to 5.}$$

15. An electric accessory according to claim 14 wherein said first body member includes said plurality of pin members and said second body member includes said plurality of apertures.

16. An electric accessory according to claim 14 wherein said second body member includes said plurality of pin members and said first body member includes said plurality of apertures.

* * * * *